US005217621A

United States Patent [19]

Norris

[11] Patent Number: 5,217,621

[45] Date of Patent: Jun. 8, 1993

[54] CARBONIZATION OF LIQUID

[75] Inventor: Aubrey O. Norris, Tomball, Tex.

[73] Assignee: Liquid Carbonic Industries Corporation, Chicago, Ill.

[21] Appl. No.: 809,967

[22] Filed: Dec. 18, 1991

[51] Int. Cl.[5] ..... B01F 3/04

[52] U.S. Cl. ..... 210/743; 210/96.1; 210/220; 261/124; 261/DIG. 7

[58] Field of Search ..... 261/30, 124, 117, DIG. 7; 210/220, 96.1, 743, 220

[56] References Cited

U.S. PATENT DOCUMENTS

| | | | |
|---|---|---|---|
| 867,356 | 10/1907 | Fox . | |
| 889,516 | 6/1908 | Fox . | |
| 2,081,029 | 5/1937 | Young | 261/DIG. 7 |
| 2,226,958 | 12/1940 | Zahm et al. . | |
| 2,252,313 | 8/1941 | Bostock . | |
| 2,503,376 | 4/1950 | Burgess | 261/DIG. 7 |
| 2,514,463 | 7/1950 | Bayers, Jr. | 261/DIG. 7 |
| 2,588,677 | 3/1952 | Welty et al. | 261/DIG. 7 |
| 3,048,164 | 8/1962 | Walker | 261/DIG. 7 |
| 3,208,935 | 9/1965 | Nesbitt | 261/DIG. 7 |
| 3,578,215 | 5/1971 | Iannelli | 261/DIG. 7 |
| 3,976,445 | 8/1976 | Douglas | 261/DIG. 7 |
| 4,298,467 | 11/1981 | Gartner et al. | 261/124 |
| 4,482,509 | 11/1984 | Iannelli | 261/DIG. 7 |
| 4,632,275 | 12/1986 | Parks | 261/DIG. 7 |
| 4,670,157 | 6/1987 | Nicksic | 210/743 |

*Primary Examiner*—Tim Miles

*Attorney, Agent, or Firm*—Lee, Mann, Smith, McWilliams, Sweeney & Ohlson

[57] ABSTRACT

A method and apparatus for carbonating a liquid by creating a pressurized atmosphere of carbon dioxide in a container, spraying a liquid, including a caustic containing liquid, into the atmosphere to cause an interaction between the liquid and the carbon dioxide, collecting a pool of liquid in the bottom of the container, and sparging carbon dioxide under pressure through the pool, and an apparatus for same.

8 Claims, 1 Drawing Sheet

CARBONIZATION OF LIQUID

BACKGROUND OF THE INVENTION

Carbon dioxide gas has been injected into liquids, particularly water, for many purposes. For example, carbonated beverages, including water, beer and the like, have been made by injection of $CO_2$. See for example, U.S. Pat. Nos. 889,516, 2,226,958 and 2,252,313. Lime tainted water has been treated to reduce deposits and contamination of vessels and tubes. This was often done by using the by-products of combustion. See for example, U.S. Pat. Nos. 3,208,935 and 3,976,445. None of the prior methods provide proper control of the carbonization process. Processes using the by-products of combustion are particularly cumbersome. A water stream has also been sparged with $CO_2$ in an unpressurized sump or low pressure pipe. Sparging efficiency in such an operation has been low.

SUMMARY OF THE INVENTION

In the process and apparatus of this invention, carbon dioxide gas is injected into a reaction chamber, generally through bottom spargers, to maintain a pressure of between 55–60 psig. A liquid solution, water or a caustic solution, is sprayed into the top of the vessel or chamber. This creates a large surface area of the liquid with which the gaseous $CO_2$ reacts. As a pool of partially reacted liquid solution builds up in the bottom of the vessel, the bottom spargers introduce additional $CO_2$ under pressure to react with the liquid, thus giving increased carbonization of the liquid or reduction of any caustic substance present. The rate of the reaction can be controlled to provide a desired level of carbonization or pH of the liquid by maintaining the level of the fluid in the vessel and the pressure of the $CO_2$.

DETAILED DESCRIPTION OF THE PREFERRED EMBODIMENT

Figure 1:
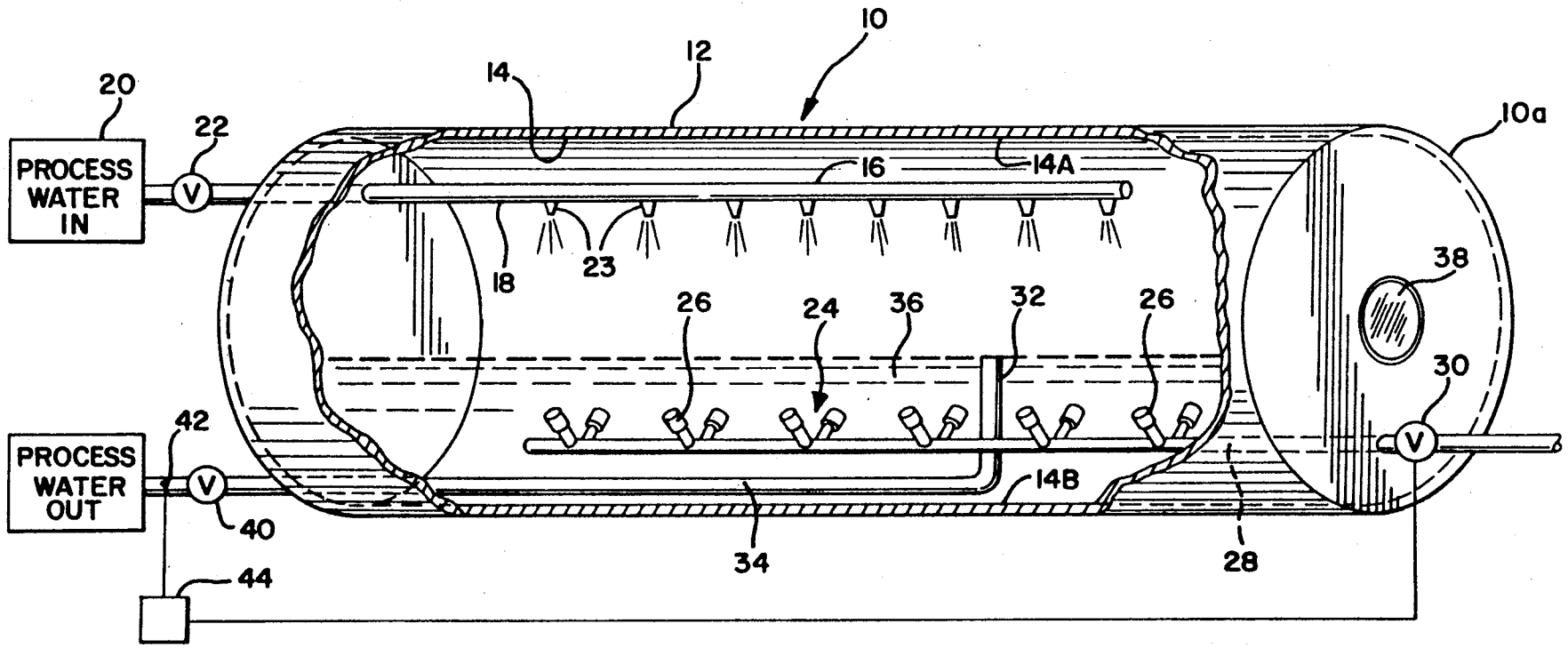
FIG. 1 is a front elevational view, partially broken away, to show the interior mechanisms of the carbonating vessel of this invention.

The reaction vessel 10 is a 1500 gallon capacity container, the outer surface of which is coated 12 with a heat resistant epoxy paint similar to that used on automobile engines, i.e. heat insensitive. The interior surfaces 14 of the vessel 10 are coated with several layers, preferably four, of an electro-coated polyresin to protect the metal from any heat or caustic materials. A spray manifold 16 affixed by any conventional means, such as welding, to the top or ceiling 14A of the vessel. The manifold 16 is connected through a pipe 18 to the process water inlet 20 which enters through valve 22. It is through this pipe and manifold that the untreated stream of water or caustic enters the vessel and is sprayed into the interior thereof through a plurality of outlet apertures 23 in the manifold 16.

Located in the bottom 14B of the vessel 10 is a second manifold 24 which has a plurality of metal $CO_2$ spargers 26. These spargers 26 are sometimes referred to as Mott-type spargers and normally about twelve (12) of these satisfy the sparging needs of this invention. The spargers 26 are attached by conventional means, such as screw threads, to a pipe 28 which is attached to the $CO_2$ inlet valve 30. It is through the inlet valve 30 the pipe 28 and the spargers 26 that the $CO_2$ is introduced into the vessel 10 where it is maintained at a pressure of between 55–60 psig.

In order to maintain a sufficient liquid level allowing sparging of the liquid, a standpipe 32 is provided. It is through the standpipe 32 and the discharge pipe 34 that the treated process liquid 36 leaves the vessel 10.

In operation, the unit of the invention may be used to carbonate water or other liquids but more preferably, it may be used to lower the pH of highly caustic liquids. In such a case, $CO_2$ is introduced into the vessel 10 through the bottom spargers 26 to an internal pressure of 55–60 psig. A shut off valve 40 in the discharge line 34 holds the pressure initially. The caustic solution is sprayed (or sparged) into the top 14A of the vessel 10 through the spray manifold 16 thereby creating a large surface area of liquid with which the gaseous $CO_2$ reacts. As the pool 36 of partially reacted caustic solution builds up in the bottom of the vessel, the spargers 26 supply additional agitation to further react the $CO_2$ with the liquid to finish the reducing process.

So that visual control may be had, a graduated sight glass 38 is provided in the vessel wall 10A. The level of fluid 36 in the vessel in maintained by a differential pressure cell (not shown) which controls a modulating valve (not shown) on the down side of the reaction which controls the amount of process fluid being introduced. The level of the reacting caustic fluid is generally maintained at 60%.

The injection rate of $CO_2$ is controlled by a pH probe 42 in the discharge line or pipe 34 preferably about sixty (60) feet from the reactor vessel 10. A signal from this probe is transmitted into a pH meter/controller 44 which in turn activates the $CO_2$ inlet valve 30. A bypass line (not shown) is also provided so that the $CO_2$ does not have to stop during operation.

Various features of the invention have been particularly shown and described in connection with the illustrated embodiments of the invention, however, it must be understood that these particular arrangements merely illustrate, and that the invention is to be given its fullest interpretation within the terms of the appended claims.

What is claimed is:

1. A method for carbonating a liquid comprising the steps of:

creating a pressurized atmosphere of carbon dioxide in a container having a top and a bottom;

connecting a first manifold having a plurality of outlet apertures to a source of said liquid, said first manifold being located at said top of said container;

spraying said liquid into said atmosphere through said outlet apertures so as to cause an interaction between said liquid and said carbon dioxide atmosphere;

collecting a pool of said liquid in the bottom of said container;

connecting an inlet valve to a source of pressurized carbon dioxide;

connecting a second manifold located at said bottom of said container to said inlet valve, said second manifold including a plurality of spargers located below the surface of said pool of liquid;

sparging carbon dioxide under pressure through said spargers and through said pool, said inlet valve controlling the flow rate of pressurized gas through said spargers;

discharging reacted liquid in said pool from said container through a discharge pipe;

monitoring the pH of the reacted liquid in said discharge pipe with a pH probe;

transmitting a signal from said pH probe to said carbon dioxide inlet valve to control the flow rate of carbon dioxide through said spargers; and maintaining the surface of said pool of liquid at a desired level as carbon dioxide is sparged through said pool of liquid.

2. The method of claim 1 wherein said liquid contains a caustic material.

3. The method of claim 2 wherein said caustic material is substantially neutralized by said carbon dioxide.

4. The method of claim 1 wherein the pressure in said atmosphere is between 55 and 60 psig.

5. The apparatus of claim 1 wherein said means for maintaining the level of the liquid in said vessel comprises a stand pipe.

6. The apparatus of claim 1 wherein said monitoring means comprises a pH probe.

7. An apparatus for carbonating a liquid comprising:

a vessel having a top and a bottom and adapted to receive a gas atmosphere under pressure;

a first manifold located in said vessel adjacent said top and being connectable to a source of the liquid, said first manifold including a plurality of outlet apertures such that the fluid is sprayed into the gas atmosphere through said apertures and collects as a pool of liquid at said bottom of said vessel;

an inlet valve connected to a source of pressurized gas;

a second manifold located in said vessel adjacent said bottom, said second manifold being connected to said inlet valve and including a plurality of spargers;

means for maintaining the level of the liquid in the pool at a desired level;

a discharge pipe connected to said liquid level maintaining means for discharging reacted liquid from said vessel;

means located in said discharge pipe for monitoring the pH of the reacted liquid in said discharge pipe, said monitoring means being operatively connected to said inlet valve to control the flow rate of gas delivered to the liquid in said vessel through said spargers in response to the pH of the reacted fluid in said discharge pipe.

8. The apparatus of claim 7 wherein said gas comprises carbon dioxide.

* * * * *